US005791305A

United States Patent [19]

Kather et al.

[11] Patent Number: 5,791,305

[45] Date of Patent: Aug. 11, 1998

[54] METHOD FOR MONITORING A CYLINDER VALVE, ACTUATED VIA AN ELECTROMAGNETIC ACTUATOR, IN A PISTON-TYPE INTERNAL COMBUSTION ENGINE

[75] Inventors: Lutz Kather, Würselen; Guenter Schmitz; Ekkehard Schrey, both of Aachen, all of Germany

[73] Assignee: FEV Motorentechnik GmbH & Co KG, Aachen, Germany

[21] Appl. No.: 694,429

[22] Filed: Aug. 8, 1996

[30] Foreign Application Priority Data

Aug. 18, 1995 [DE] Germany ..... 195 30 394.6

[51] Int. Cl.[6] ..... F01L 9/04

[52] U.S. Cl. ..... 123/90.11; 251/129.01

[58] Field of Search ..... 123/90.11; 251/129.01, 251/129.09, 129.1, 129.16

[56] References Cited

U.S. PATENT DOCUMENTS 4,794,891 1/1989 Knobloch ..... 123/90.11
4,823,825 4/1989 Buchl ..... 123/90.11
5,596,956 1/1997 Ogawa et al. ..... 123/90.11

FOREIGN PATENT DOCUMENTS 30 24 109 9/1989 Germany .

*Primary Examiner*—Weilun Lo
*Attorney, Agent, or Firm*—Spencer & Frank

[57] ABSTRACT

A method is provided for monitoring a cylinder valve which is actuated by an electromagnetic actuator including an electromagnet having a magnetic core presenting a pole face and a coil wound around the magnetic core, a return spring and an armature that can be moved by the electromagnet in a direction toward the pole face counter to a force of the return spring for acting upon the cylinder valve. The method includes: measuring a value of one of (a) a time until current in the coil drops to a predetermined lower value after a switching of the current flowing through the coil, (b) a voltage at the coil subsequent to the switching of the current to the coil, (c) the voltage at the coil at a time of maximum approach of the armature to the pole face, and (d) the voltage at the coil at a time subsequent to the time of maximum approach of the armature to the pole face; comparing the measured value to a predetermined value; and generating a signal if a deviation is detected between the measured value and the predetermined value.

1 Claim, 4 Drawing Sheets

METHOD FOR MONITORING A CYLINDER VALVE, ACTUATED VIA AN ELECTROMAGNETIC ACTUATOR, IN A PISTON-TYPE INTERNAL COMBUSTION ENGINE

CROSS-REFERENCE TO RELATED APPLICATIONS

This application claims the right of priority of application DE 195 30 394.6 filed in Germany on Aug. 18, 1995, the disclosure of which is incorporated herein by reference.

BACKGROUND OF THE INVENTION

Cylinder valves for piston-type internal combustion engines can be operated by actuators, wherein each cylinder valve is connected to an electromagnetic actuator. Such an electromagnetic actuator has at least one electromagnet and one armature that acts upon the cylinder valve. The armature is moved counter to the force of at least one return spring with the aid of the electromagnet. The electromagnetic actuators render it possible to effect an adaptable control for the inflow and outflow of working medium to the individual cylinders, so that the method of operation can be influenced optimally, according to the required aspects in each case. The control sequence here has a considerable effect on the various parameters, for example the working medium conditions in the inflow area, in the working area, and the outflow area, as well as on the processes in the working area itself. Such a cylinder valve control with the use of electromagnetic actuators is disclosed in, for example, German Patent No. 3,024,109.

In contrast to traditional valve controls, which are guided by a camshaft, such electromagnetically actuated cylinder valves have the problem that a cylinder valve may not function during operation.

As a rule, an electromagnetic actuator for actuating a cylinder valve has two electromagnets between which an armature, operating jointly with the cylinder valve, can be moved back and forth counter to the force of one return spring, respectively. In this case, the cylinder valve is kept, via the armature, in the closed position by one electromagnet, referred to as the closing magnet, and in the open position by the other electromagnet, referred to as the opening magnet. The armature movement is induced in that the power is cut off at the respectively holding electromagnet so that under the influence of the corresponding return spring, the armature moves with accelerating movement in the direction of the other electromagnet. The armature thereby passes through a neutral position, and is then captured by the capturing electromagnet through the appropriately timed switching on of the power to the capturing magnet, and subsequently comes to rest against its pole surface.

In this connection, it can happen that due to irregularities or malfunctions or changes in operation, for example, the armature detaches itself from the holding electromagnet, but does not come to rest against the capturing magnet, despite the fact that this magnet is under power. In such an event the armature may come to rest in the neutral position, defined by the balanced condition of the antagonistic return springs. Accordingly, the corresponding cylinder valve remains in the half-open position while all other cylinder valves operate normally.

SUMMARY OF THE INVENTION

It is an object of the invention to provide a method for monitoring such electromagnetically operated cylinder valves, which permits the restarting of a failed cylinder valve during the operation.

The above and other objects are accomplished according to the invention by the provision of a method for monitoring a cylinder valve which is actuated by an electromagnetic actuator comprising an electromagnet including a magnetic core presenting a pole face and a coil wound around the magnetic core, a return spring and an armature that can be moved by the electromagnet in a direction toward the pole face counter to a force of the return spring for acting upon the cylinder valve when switching the current in the coil, the method comprising: measuring a value of one of (a) a time until current in the coil drops to a predetermined lower value after a switching of the current flowing through the coil, (b) a voltage at the coil subsequent to the switching of the current to the coil, (c) the voltage at the coil at a time of expected contact of the armature at the pole face, and (d) the voltage at the coil at a time subsequent to the time of expected contact of the armature at the pole face; comparing the measured value to a predetermined value; and generating a signal if a deviation is detected between the measured value and the predetermined value.

This method exploits the finding that the magnetic field energy depends on whether the armature rests against the pole face of the electromagnet or not. If the power is cut off, regardless of whether it goes down to zero or a lower holding current, a clearly higher magnetic energy results if the armature rests against the pole face of the electromagnet, as compared to a cut-off where the armature is at a distance to this electromagnet. From that, it can be deduced that the armature rested against the pole face at cut-off if the magnetic energy is higher as compared to a predetermined limit value. The armature did not make contact if the magnetic energy is below this limit value at cut-off.

The simplest way of measuring the respectively effective cut-off energy is by measuring the time from the cut-off of the current flowing through the coil of the electromagnet that is supposed to be holding the armature to the drop of the current below a predetermined value. If, for example, the current is turned off completely to free the cylinder valve for a movement in the direction of the other electromagnet, the current drop to a zero value for an armature resting against the pole face of the holding electromagnet takes a lot longer than in the case when the armature either did not make contact at all or has detached itself prematurely because of interference. In this case, a lower limit value results for drop time $t_{ab}$ for the normal situation so that a corresponding signal can be triggered if the limit for drop time $t_{ab}$ is not reached. Such a signal can, for example, be used to introduce measures via a control to restart the armature and thus also return it to its normal back and forth motion.

Control methods for electromagnetic actuators are known, for which a predetermined cut-off time must be maintained, for example, through an additional accelerating force applied to the armature. In this case, monitoring while the holding current is cut off can also be effected by measuring the maximum cut-off voltage $U_{ab}$ that occurs at the coil. The cut-off voltage $U_{ab}$ is also proportional to the magnetic cut-off energy of the electromagnet. The cut-off voltage $U_{ab}$ is higher if the armature makes contact with the pole face of the electromagnet, than in a case where the armature does not come to rest against the pole face of the electromagnet or where it has detached itself prematurely from it. Here too, a signal can be generated for cut-off voltage $U_{ab}$ through comparison with a predetermined limit value, if a cut-off voltage is detected during operation which falls below the predetermined value for cut-off voltage $U_{ab}$.

The two methods listed above can be used also if the holding magnet is actuated such that during the "capturing phase," the current initially is adjusted upward to a maximum value $I_{max}$, is then adjusted to remain at a constant level during the capturing period to be expected and is cut back to a lower holding current, following the assumed striking and making contact of the armature with the pole face. Due to outside influences, it can happen here that the armature either does not reach the pole face at all or detaches itself from the pole surface during the suspected "capturing phase" already. If the current is then switched from the maximum value $I_{max}$ to the lower value of holding current $I_H$, it is possible to determine either through the time measurement, or even more advantageously through a measurement of the cut-off voltage occurring at the coil, whether the armature rests at this moment against the pole face of the electromagnet.

The invention is explained below in more detail with the aid of the accompanying drawings.

DETAILED DESCRIPTION OF THE PREFERRED EMBODIMENTS

Figure 1:
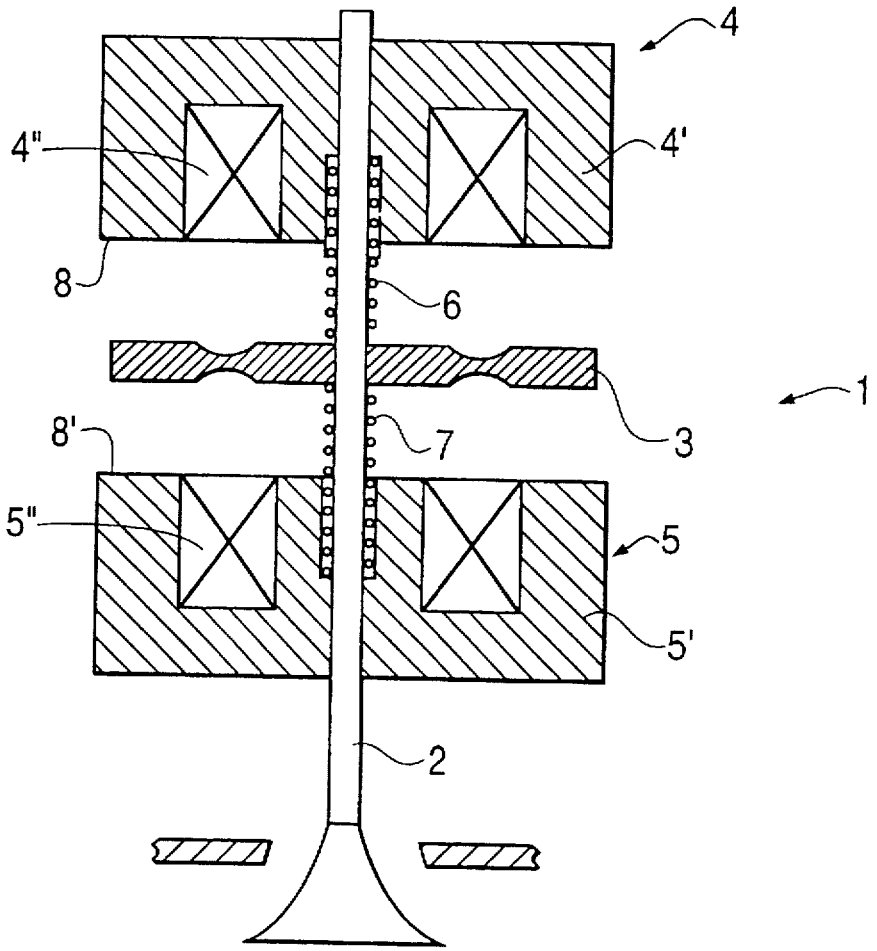
FIG. 1 is a schematic cross section of an electromagnetic actuator with which the method of the invention may be used.

Referring to FIG. 1, there is schematically shown an electromagnetic actuator 1 which includes an armature 3 connected to a stem 2 of a cylinder valve (not shown). A closing electromagnet 4 (hereafter the "closing magnet") comprises a magnetic core 4' and a coil 4", and has a pole face 8. An opening electromagnet 5 (hereafter the "opening magnet") comprises a magnetic core 5' and a coil 5", and has a pole face 8'. Restoring springs 6 and 7 are disposed between armature 3 and pole faces 8 and 8', respectively. When the magnets 4 and 5 are both currentless, that is current is turned off at both coils 4" and 5", armature 3 is held by restoring springs 6 and 7 in a resting position between the magnets, with the respective distances from the pole faces 8 and 8' of magnets 4 and 5 being a function of the configuration of springs 6 and 7. In the illustrated embodiment, springs 6 and 7 are configured identically, so the resting position of armature 3 is in the center between pole faces 8 and 8', as shown in FIG. 1. In a closed position of the cylinder valve, armature 3 rests against pole face 8 of closing magnet 4.

To actuate cylinder valve 2, that is, to initiate a movement from the closed position into an open position, the holding current at closing magnet 4 is shut off. Consequently, the holding force of closing magnet 4 drops and armature 3 begins to move, with acceleration being provided by the spring force of restoring spring 6. After armature 3 has passed through its resting position, the "flight" of the armature is slowed by the spring force of restoring spring 7 associated with opening magnet 5. In order to capture armature 3 to place it in the open position and to hold it there, opening magnet 5 is charged with current so that the armature comes to rest against pole face 8' of magnet 5. To close the cylinder valve, the course of switching and movement is effected in the opposite direction.

Figure 2A:
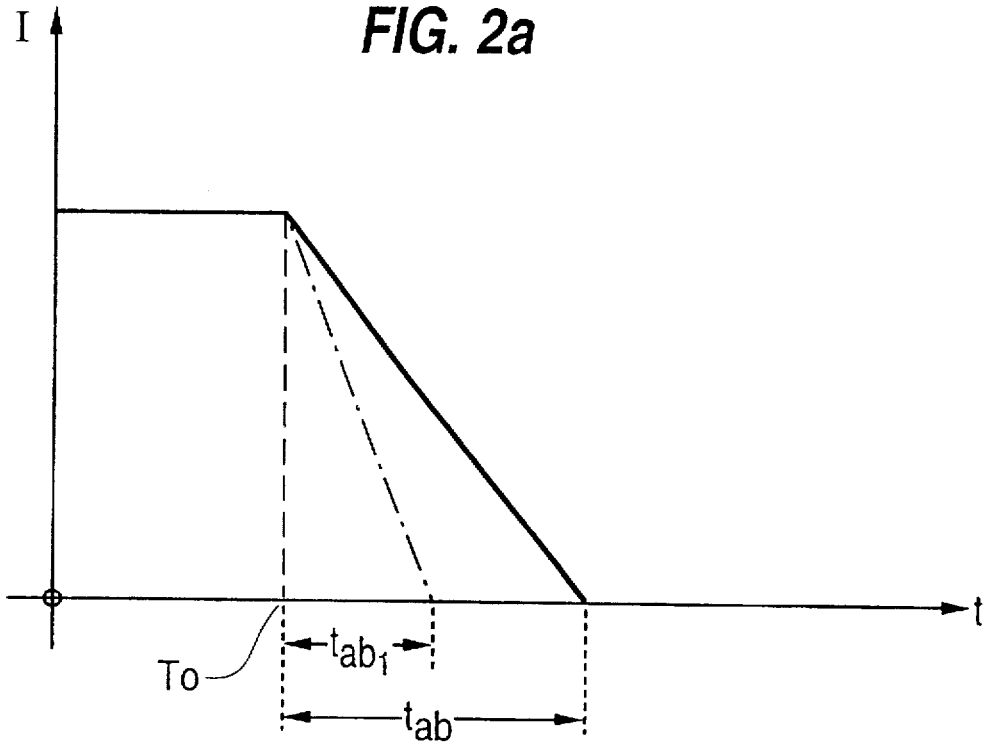
FIGS. 2*a* and 2*b* are diagrams showing time histories of current and a corresponding voltage, respectively, during a cut-off phase of an electromagnet for monitoring with a time measurement.
Figure 2B:
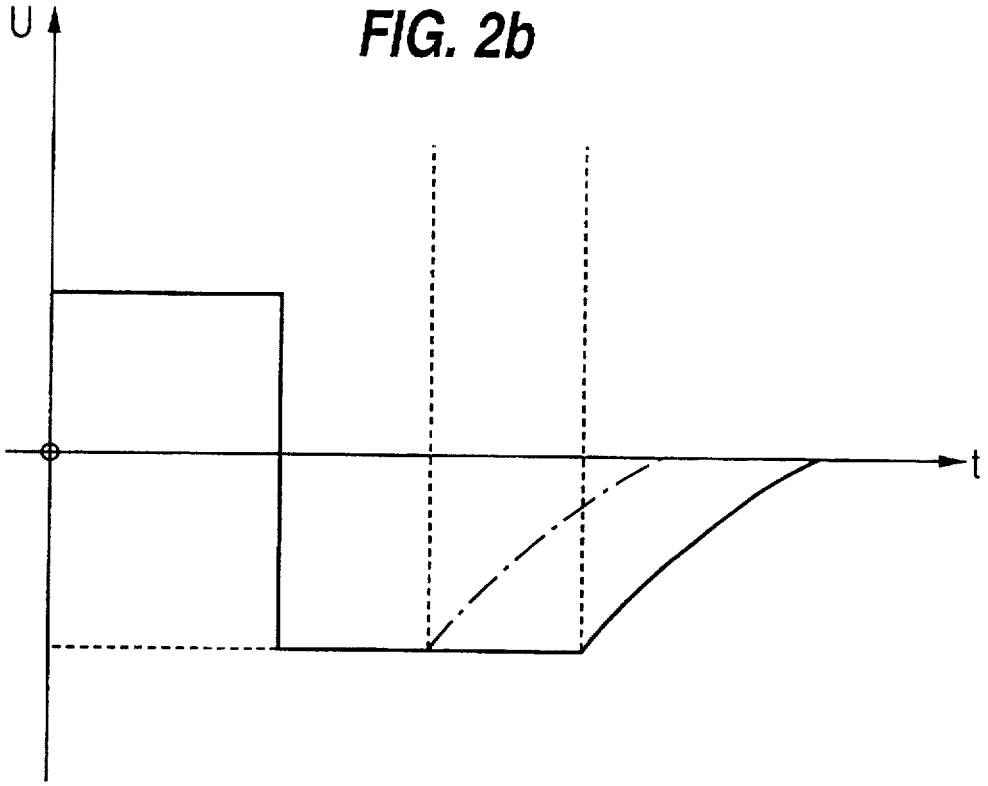

If the captured armature is to be released by one of the electromagnets, then the current at time $T_0$ is cut off as shown by the solid line in FIG. 2*a*. If the armature is abutting the pole face of the capturing electromagnet, the current needs a certain amount of time to drop to zero because of the reduction of the magnetic field energy. The current needs time $t_{ab}$ to drop to zero because a high magnetic field energy exists if the armature rests against the electromagnet. The corresponding time history for the voltage measured at the coil of the electromagnet is shown in FIG. 2*b* as a solid line.

If, however, the armature does not rest against the pole face when the current is cut off, the drop time for the current is reduced considerably. In this event, only time $t_{ab1}$ is needed for the current to drop to zero, as is shown in FIG. 2*a* with the dash-dot curve. The corresponding time history of the voltage is also shown in FIG. 2*b* by the dash-dot curve.

Thus, the time for the current to drop to zero after cut off can be monitored to indicate whether or not the armature rests against a pole face at the beginning of a switching operation.

However, as described above, there are control methods where time $t_{ab}$ is predetermined through external presetting, that is the armature is detached from the pole surface with the aid of additional, accelerating magnetic forces, for example. In those cases, time measurements cannot be used for the monitoring.

Figure 3A:
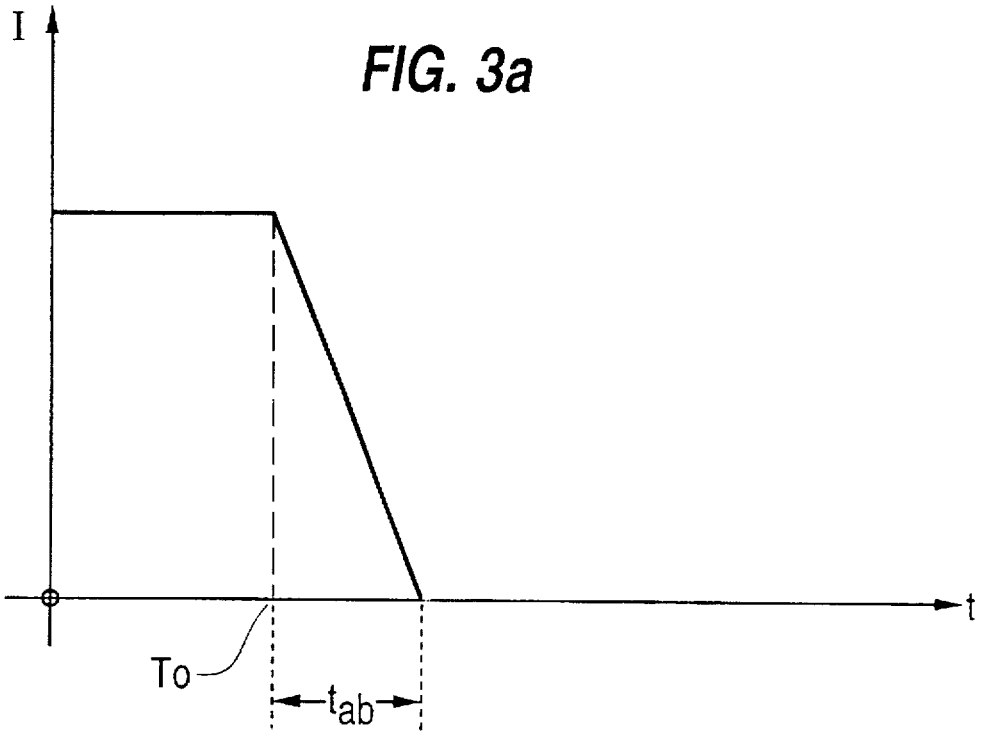
FIGS. 3*a* and 3*b* are diagrams showing time histories of current and a corresponding voltage, respectively, for monitoring with a voltage measurement.
Figure 3B:
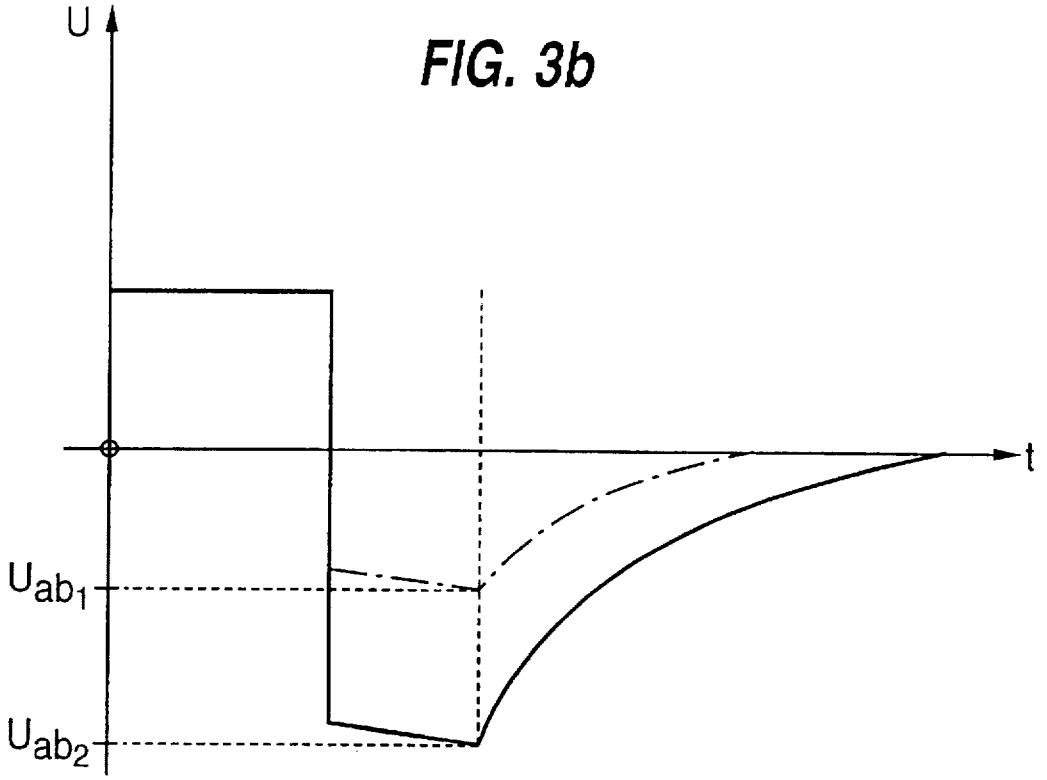

A time history of current is shown in FIG. 3*a* in the case of a predetermined cut-off time $t_{ab}$. The corresponding time history for the voltage measured at the electromagnet coil is shown in FIG. 3*b*. If functioning normally and if the armature abuts the pole face of the holding electromagnet, a cut-off voltage $U_{ab2}$ is measured while the current inside the coil drops during a fixed, predetermined time interval, as is shown by the solid curve in FIG. 3*b*.

However, if the armature does not rest against the electromagnet, then a clearly lower cut-off voltage $U_{ab1}$ results because the magnetic field energy that must be reduced is correspondingly lower. If the armature does not abut against the pole face, the voltage time history for the cut-off voltage is in turn shown with a dash-dot line.

As an alternative to a defined current cut-off, the cut-off voltage can be superimposed on a capacitor which then charges itself up-with the coil energy. It makes sense if this charging process occurs via a rectifying element such as a diode, so that the voltage generated in the capacitor does not cause another current to flow through the coil after it is charged up, rather that the recharging process is completed once the current drops to zero. The voltage adjusted at that point is proportional to the energy previously stored in the coil and thus is considerably higher for the case where the armature abuts than where the armature does not abut at the time of cut-off.

Figure 4A:
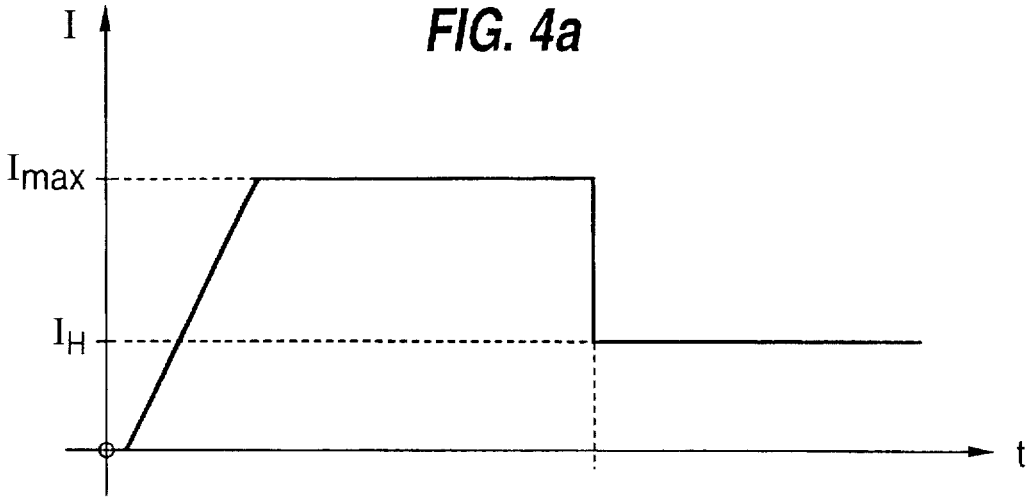
FIGS. 4*a*, 4*b* and 4*c* are diagrams showing current, a corresponding voltage and an armature stroke, respectively, during a return movement of the armature in the capturing phase.
Figure 4B:
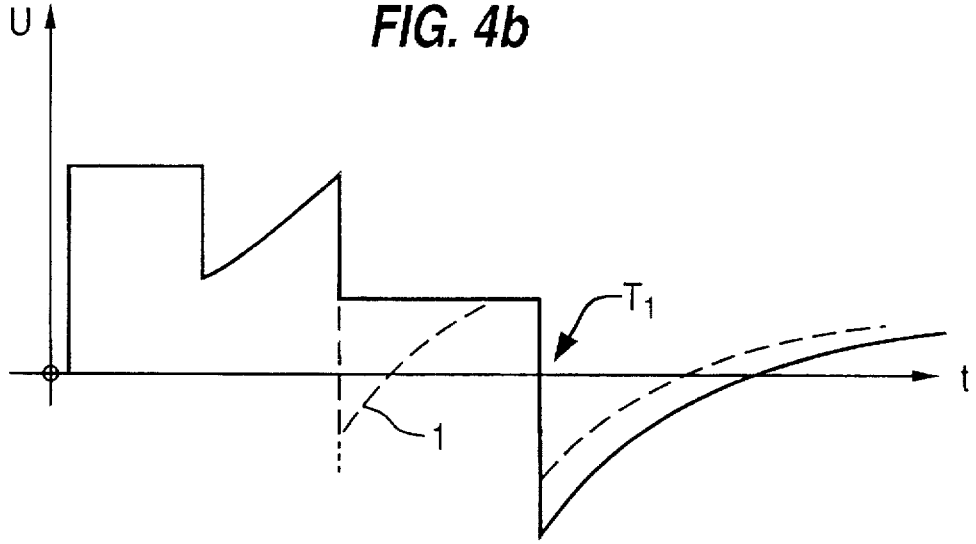
Figure 4C:
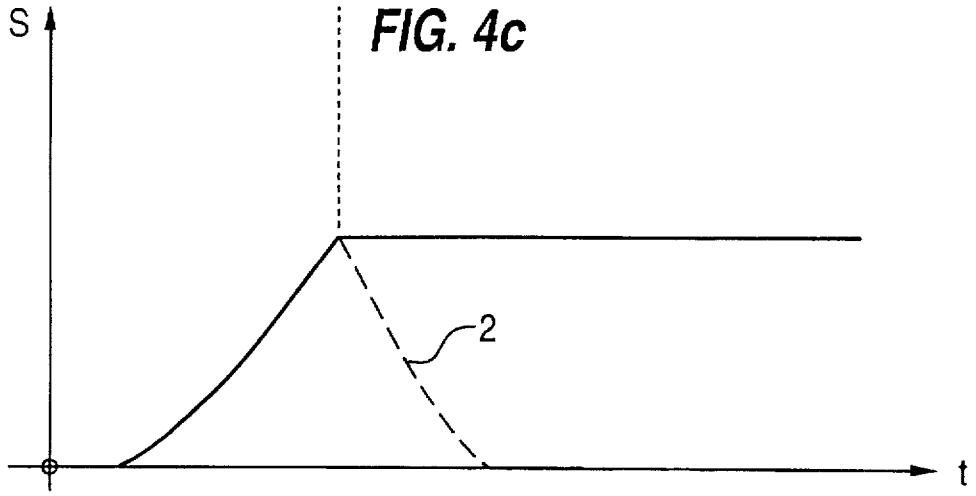

FIGS. 4*a*, 4*b* and 4*c* show, respectively, corresponding time histories for current and voltage of a capturing magnet, and the armature path during a return movement of the armature in the capturing phase. As is obvious from FIG. 4*a*, the current is initially adjusted up to a predetermined maximum value $I_{max}$ to introduce the "capturing phase," and is initially kept constant there. The corresponding voltage history in FIG. 4*b* shows that the voltage remains constant during the increase in current, but drops later, during the changeover to the constant current phase. If the armature then moves toward the pole surface as shown in FIG. 4*c*, the voltage rises again to a higher value as a result of a change in the magnetic induction, only to drop again to a the low value associated with the constant current control.

Since it can be assumed, following a certain interval of constant current control and on the basis of the design and controlling technological conditions, that the armature has come to rest against the pole face of the capturing electromagnet, the current is adjusted down from its value $I_{max}$ to a lower holding current $I_H$. This results in the voltage history shown by the solid curve in FIG. 4*b*.

If, however, the armature has touched the pole face of the electromagnet, as shown in the voltage history in FIG. 4*b*, yet was not held there by the electromagnet due to malfunctions, and fell away as shown in FIG. 4*c* with the dashed line 2, this fact can be detected from the obviously different voltage history to be measured at the coil at the time of switchover from maximum current $I_{max}$ to holding current $I_H$. A corrective signal can be derived from this deviation, which can be used to switch respective control measures, e.g., used to restart the armature movement for the electromagnetic actuator through stimulating oscillations via two-way wiring of the two electromagnets.

Another possibility of recognizing when the armature detaches itself results from the evaluation of the voltage in the constant current phase. If a voltage value occurs at the coil that is lower than the product of current and internal resistance of the coil, it can be caused only by a movement of the armature away from the pole face. If the armature moves away completely, according to curve 2 in FIG. 4*c*, a voltage history according to curve 1 in FIG. 4*b* results. To make sure that a short-term rebounding of the armature with subsequent clean abutting of the armature does not trigger the diagnostic signal indicating an "armature failure," an armature drop-off is recognized only if the voltage reading falls below a certain level. Also, in order to compensate for series tolerances, the voltage after the armature makes contact can be compared to the voltage at the end of the constant current phase so that an armature failure is detected if the voltage shows a clearly higher value at time $T_1$ than at an earlier time following contact. This has the advantage of permitting a clear detection without mistakes, even for tolerance variation in the constant current and the internal resistance of the coil.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A method for monitoring a cylinder valve which is actuated by an electromagnetic actuator comprising an electromagnet including a magnetic core presenting a pole face and a coil wound around the magnetic core, a return spring and an armature that can be move by the electromagnet in a direction toward the pole face counter to a force of the return spring for acting upon the cylinder valve when switching the current in the coil, comprising:

measuring a value of one of (a) a time until current in the coil drops to a predetermined lower value after a switching of the current flowing through the coil, (b) a voltage at the coil subsequent to the switching of the current to the coil, (c) the voltage at the coil at a time of expected contact of the armature at the pole face, and (d) the voltage at the coil at a time subsequent to the time of expected contact of the armature at the pole face;

comparing the measured value to a predetermined value; and generating a signal if a deviation is detected between the measured value and the predetermined value.

* * * * *